US006427766B2

(12) United States Patent
Zobel et al.

(10) Patent No.: US 6,427,766 B2
(45) Date of Patent: Aug. 6, 2002

(54) EQUALIZATION VESSEL FOR VEHICULAR COMPACT COOLING SYSTEMS

(75) Inventors: Werner Zobel, Boblingen; Michael Ehlers, Nagold; Frank Vetter, Filderstadt; Jorg Soldner, Ehningen; Roland Strähle, Unterensingen; Wolfgang Knecht, Stuttgart, all of (DE); Mark G. Voss, Franksville, WI (US); Andreas Willman, Tübingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/833,313

(22) Filed: Apr. 10, 2001

(30) Foreign Application Priority Data

Apr. 12, 2000 (DE) ..... 100 18 089

(51) Int. Cl.[7] ..... F01P 5/06; F01P 11/02

(52) U.S. Cl. ..... 165/132; 165/104.32; 165/41; 123/41.49

(58) Field of Search ..... 165/41, 51, 132, 165/104.32, 125, 126

(56) References Cited

U.S. PATENT DOCUMENTS 3,921,603 A * 11/1975 Bentz et al. ..... 123/41.33
4,202,296 A * 5/1980 Nonnenmann et al. .. 123/41.48
4,377,203 A * 3/1983 Ejima ..... 123/41.44
6,129,056 A * 10/2000 Skee et al. ..... 123/41.49
6,145,479 A * 11/2000 Rotter ..... 123/41.11

FOREIGN PATENT DOCUMENTS

| | | |
|---|---|---|
| DE | 3912734 | 10/1990 |
| DE | 4117336 | 12/1992 |
| EP | 0020005 | 12/1980 |
| EP | 0393654 | 4/1990 |

* cited by examiner

*Primary Examiner*—Allen Flanigan
(74) *Attorney, Agent, or Firm*—Wood, Phillips, VanSanten, Clark & Mortimer

(57) ABSTRACT

A compact cooling system for a vehicle includes an assembly of heat exchangers (10), (12), (14) and (16) connected to each other to provide a box-like configuration. Each heat exchanger (10), (12), (14), (16) includes a core with headers (20), (22) at each end in fluid communication with spaced, flattened tubes (18) with fins (24) extending between the tubes in each of the cores. One of the cores (10) is generally horizontal and located at the upper side of the box-like configuration. A radial discharge fan (42) is located within the box-like configuration and receives cooling air and directs the same radially outwardly through the cores to cool fluid passing through the tubes (18) of the cores. An equalization tank (60), (80) is mounted on the box-like configuration in overlying, spaced relation to a substantial portion of the surface of the heat exchanger (18) so as to be in the path of cooling air merging from the heat exchanger (10) to divert the same.

4 Claims, 4 Drawing Sheets

EQUALIZATION VESSEL FOR VEHICULAR COMPACT COOLING SYSTEMS

FIELD OF THE INVENTION

This invention relates to compact cooling systems for vehicles. More particularly, it relates to a compact cooling system having an equalization vessel connected to engine coolant radiators for a vehicle in which the system is mounted.

BACKGROUND OF THE INVENTION

Heat exchangers for engine coolant, commonly referred to as radiators, for vehicular engines require a chamber into which the coolant can expand. It is also desirable that the coolant be able to degasify within the chamber provided for the purpose.

In the usual case, a separate equalization tank which is spaced from the headers and tanks of the radiator itself is connected within the engine coolant loop to the radiator. As the coolant is heated during engine operation, and expands as a result thereof, it may expand into the equalization tank while maintaining the coolant loop to the engine and the radiator completely occupied with coolant. In conventional cooling systems, as opposed to compact cooling systems, it is typical to run a hose from the radiator to some remote location whereat the equalization tank is located.

Compact cooling systems, however, are generally modular in nature. An entire compact cooling system will provide heat exchangers, in the usual case, that act as radiators for engine coolant, a charge air cooler for cooling engine combustion air received from a turbocharger or supercharger operated by the engine, possibly an oil cooler and frequently a condenser or gas cooler for a vehicular air conditioning system. Desirably, this entire module would include the equalization tank for the radiators to avoid the cost and time of providing a separate installation step for such a tank as well as to minimize the time and cost of connecting the radiators in the compact cooling system to the equalization tank at some remote location.

SUMMARY OF THE INVENTION

The present invention is directed to a compact cooling system for a vehicle that includes three or more heat exchangers, including heat exchangers acting as radiators and at least one heat exchanger dedicated to some other purpose. More specifically, it is an object of the invention to provide such a cooling system that can be fabricated as a module and which includes, as one of its components, an equalization tank for the radiators in the module such that upon installation of the module, the equalization tank, connected to the radiators, will be installed as a result of the installation of the compact cooling system.

An exemplary embodiment of the invention achieves the foregoing objects in a construction that includes an assembly of heat exchangers connected to each other to provide a box-like configuration. Each heat exchanger includes a core with headers and tanks at each end in fluid communication with spaced, parallel, flattened tubes in the core. Fins extend between the tubes in the core. One of the cores is generally horizontal and is located at the upper side of the box-like configuration. A radial discharge fan is disposed within the box-like configuration and is operable to receive cooling air and direct the cooling air radially outwardly through the cores to cool fluid passing through the tubes of each of the cores. An equalization tank is mounted to the box-like configuration in overlying, spaced relation to a substantial portion of the surface of the one core so as to be in the path of cooling air emerging from the one core to divert the same.

Preferably, the equalization tank has a lower, air guiding surface for directing the emerging cooling air in at least one predetermined direction.

A preferred embodiment contemplates that the box-like configuration has a front side and a rear side. The lower surface of the equalization tank is curved upwardly and away from the one core in the direction from the front side to the rear side.

A highly preferred embodiment contemplates that the one core is a charge air cooler and that there are at least two other cores. Each of the other cores has headers and tanks with one at each end of the one core and are generally vertically oriented. The other cores are radiators and are connected to each other and to the equalization tank.

One embodiment of the invention contemplates that there be provided a mounting bracket connected to the equalization tank. The mounting bracket has a plurality of fingers bonded to the flat tubes of at least one of the cores.

In a highly preferred embodiment, the box-like configuration further includes a baffle plate located at the front side which extends from the one core upwardly to the equalization vessel.

Other objects and advantages will become apparent from the following specification taken in connection with the accompanying drawings.

DESCRIPTION OF THE DRAWINGS

FIG. 6 is a sectional view across one end of a core and illustrating one form of a mounting bracket that may be utilized for attaching the equalization tank to a charge air cooler or the like.

DESCRIPTION OF THE PREFERRED EMBODIMENTS

Figure 1:
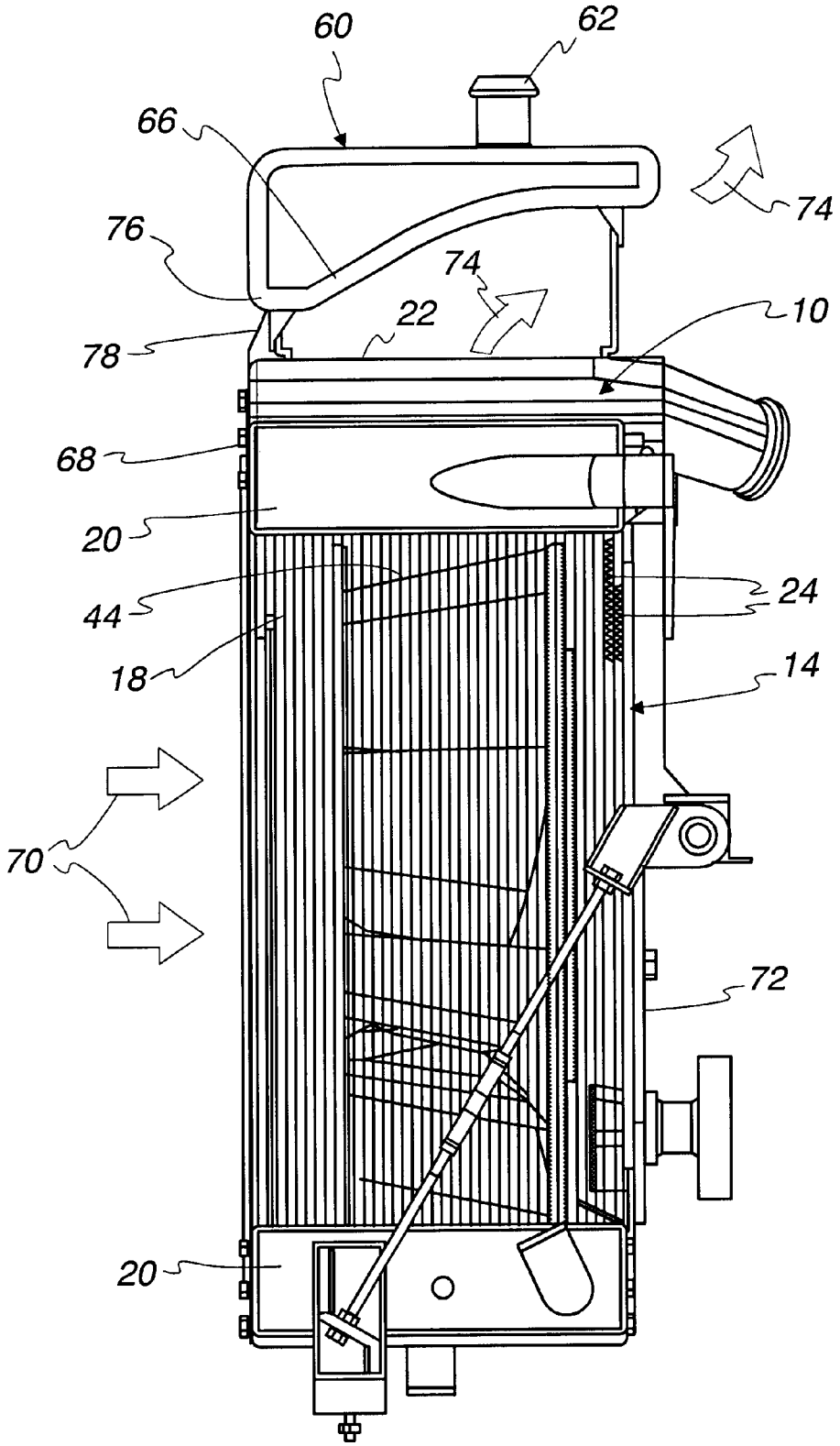
FIG. 1 is a side elevation of a compact cooling system made in accordance with the present invention.
Figure 2:
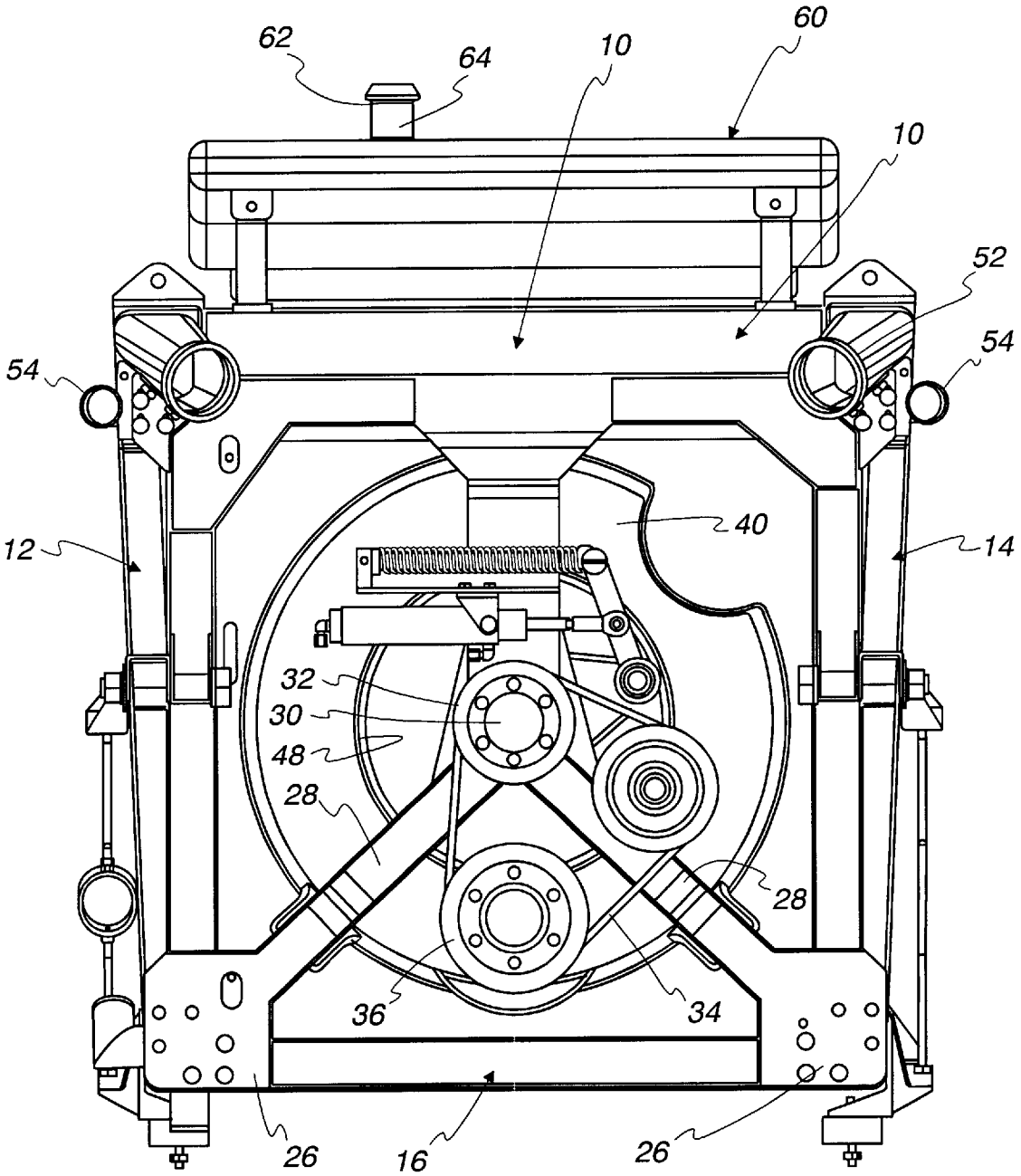
FIG. 2 is a rear elevation of the cooling system shown in FIG. 1.
Figure 3:
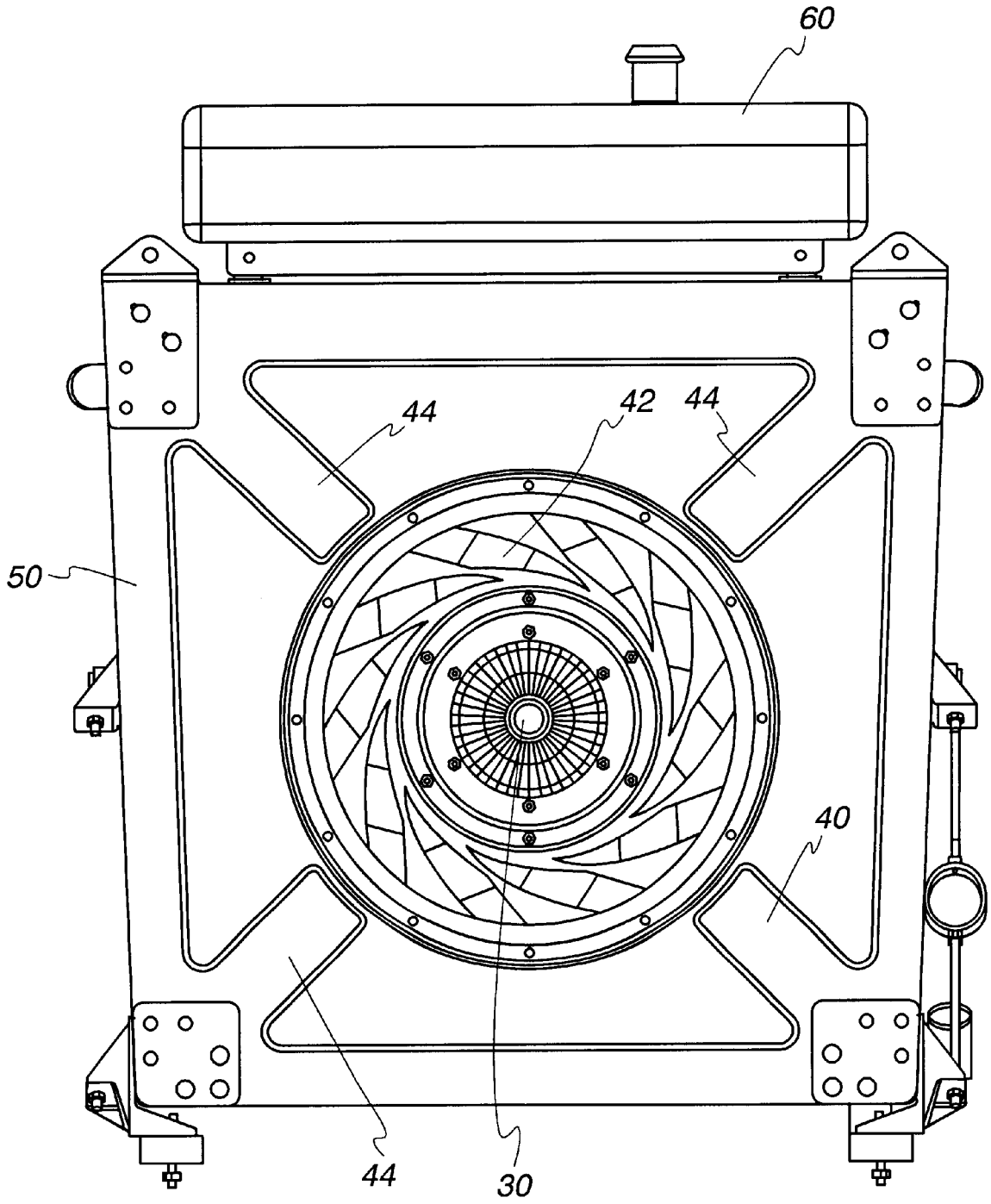
FIG. 3 is a front elevation of the cooling system shown in FIG. 1.

An exemplary embodiment of the invention is illustrated in FIGS. 1–3, inclusive wherein a compact cooling system made up of four heat exchangers is shown.

However, it is to be understood that no limitation to the number of heat exchangers intended except insofar as stated in the appended claims. In the usual case, the compact cooling system itself will have at least three, and generally four heat exchangers. For example, and referring to FIG. 2, a box-like configuration of the heat exchangers is shown as a rectangular or square box although other polygonal configurations may be employed, depending upon the number of heat exchangers. In the embodiment illustrated in FIG. 2, an upper heat exchanger, generally designated 10, is oriented generally horizontally. At each end of the heat exchanger 10 are two vertically oriented heat exchangers each generally designated 12 and 14, respectively. At their bottom ends, the heat exchangers 12 and 14 are connected by a fourth heat exchanger, generally designated 16. In a typical configuration, the heat exchanger 10 will be a charge air cooler which will be connected to the outlet of a turbocharger or a supercharger for a vehicular engine drive system. Combustion air compressed by the turbocharger or the supercharger is optimally cooled to increase engine efficiency and for this purpose is directed through the charge air cooler 10 to be cooled therein prior to being directed to the vehicle engine.

Also in a typical case, the heat exchangers 12 and 14 will both be employed for the same purpose, namely, for cooling engine coolant. They are thus acting as conventional radiators.

The lowermost heat exchanger 16, which is generally horizontal, will frequently be the condenser or gas cooler for an air conditioning system for the vehicle.

It is to be particularly noted that except insofar as set forth in the appended claims, no limitation to any particular type of heat exchanger is intended. For example, many vehicles of the type of concern include heat exchangers for cooling engine and/or transmission oil and not infrequently compact cooling systems of the sort mentioned will include a heat exchanger for that purpose as well.

Figure 6:
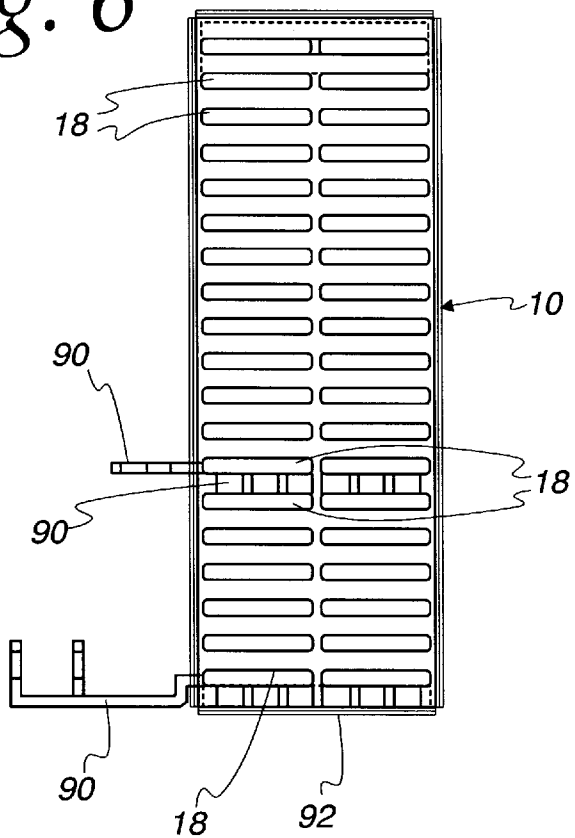

In any event, each of the heat exchangers 10, 12, 14, 16 includes a core made up of flattened tubes 18 (FIGS. 1 and 6) which are elongated and extend in parallel between headers and tanks. For example, with reference to FIG. 1, the headers and tanks 20 for the heat exchanger 14 are illustrated as well as one of the headers and tanks 22 of the heat exchanger 10. The heat exchanger 16 has headers and tanks that are invisible in FIG. 1 but located between the lower tanks 20 of the heat exchangers 12 and 14.

Typically, serpentine fins, shown schematically at 24 (FIG. 1) are disposed between the flattened tubes 18 of each of the cores making up the heat exchangers 10, 12, 14 and 16. However, if desired, plate fins could be used in lieu thereof.

As best seen in FIG. 2, brackets 26 connected to the structure at the point of adjacency of the heat exchanger 16 with the heat exchangers 12 and 14, include upwardly extending arms which mount a bearing (not shown). The bearing, in turn, mounts a shaft 30 for rotation about a generally horizontal axis that extends into the paper as illustrated in FIG. 2. The shaft also mounts a sheave 32 about which a belt 34 is trained. The belt 34 is also trained about a sheave 36 driven by the engine.

Forwardly of the components just described and within the box-like configuration of the heat exchangers 10, 12, 14 and 16 is the shroud 40 for an axial intake, radial discharge fan. The fan includes an impeller 42 shown in FIG. 3 as mounted on the shaft. Mounting brackets 44 mount the shroud 40 in proximity to the impeller 42 in a conventional fashion.

The shroud 40 includes an inlet opening 48 concentric with the rotational axis of the shaft 30 into which cooling air is drawn. Because the fan is a radial discharge fan, air drawn into the opening 48 is discharged radially outwardly to pass through the heat exchangers 10, 12, 14 and 16 to cool the fluids that are passing through the tubes 18 of each.

In addition to the brackets 26, various frame members such as shown at 50 are employed to hold the assemblage in the configuration illustrated.

It will also be noted that the various tanks are provided with hose fittings 52, 54 whereby the heat exchangers may be connected into the appropriate points in the operational systems of the vehicle with which they are used. It is to be particularly noted that in the usual case, where the heat exchangers 12 and 14 are employed as radiators for cooling engine coolant, the two are connected together.

According to the invention, an equalization tank, generally designated 60, is mounted to the assemblage and specifically, in spaced relation above the core of the heat exchanger 10. The innards of the equalization tank 60 form no part of the present invention but typically will include baffles defining two or more separate volumes within the tank 60, one for acting as an expansion tank and another for acting as a degassing section. In the usual case, a conventional pressure cap 62 will be mounted on an inlet/outlet port 64 by which coolant may be introduced into the tank 60. The tank 60 is connected to both of the heat exchangers 12 and 14 when the two are used as vehicular radiators.

Referring specifically to FIG. 1, it will be appreciated that the tank 60 includes a lower surface 66 spaced above the core of the heat exchanger 10. The front side of the compact cooling system is shown at 68 and is the side into which air is introduced as illustrated by arrows 70. The opposite or rear side is designated 72 and typically is blocked to force air to pass radially out of the assemblage.

In any event, the lower surface 66 of the tank 60 is configured so as to diverge upwardly from the heat exchanger 10 from front to rear and thus, define an air guiding surface which guides the airstream indicated by arrows 74 rearwardly away from the heat exchanger module. In the illustrated embodiment, the lower surface 66 curves upwardly from the front side 68 to the rear side 72. Preferably, the lowermost part 76 of the lower surface 66 is located above the heat exchanger 10 by a small distance so as to not include the passage of air through the forward part thereof. To provide the desired diversion of gas of cooling air flow, a plate 78 is bolted to the front side 68 of the box-like configuration at the upper heat exchanger 10. The plate 78 acts as a baffle to assist in directing air flow in the desired direction.

Figure 4:
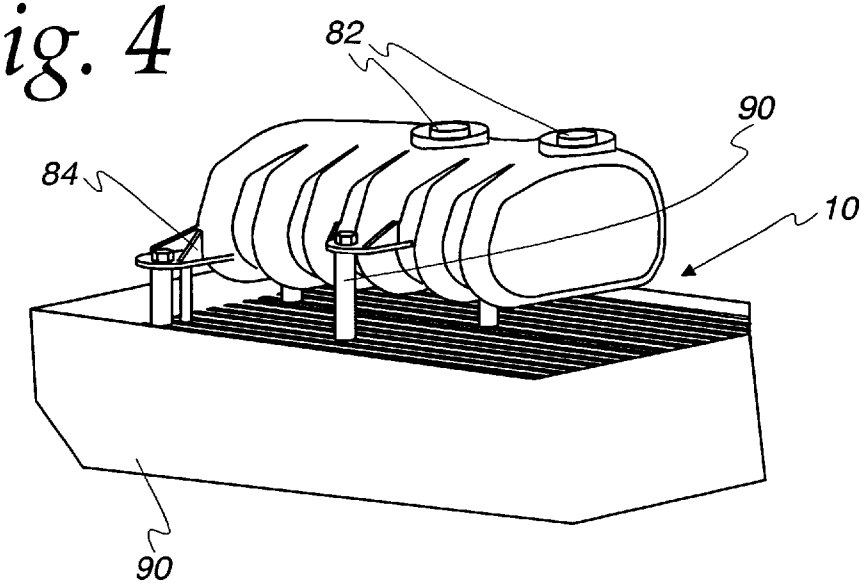
FIG. 4 is a perspective view of a charge air cooler incorporating an alternative embodiment of an equalization tank and made according to the present invention.
Figure 5:
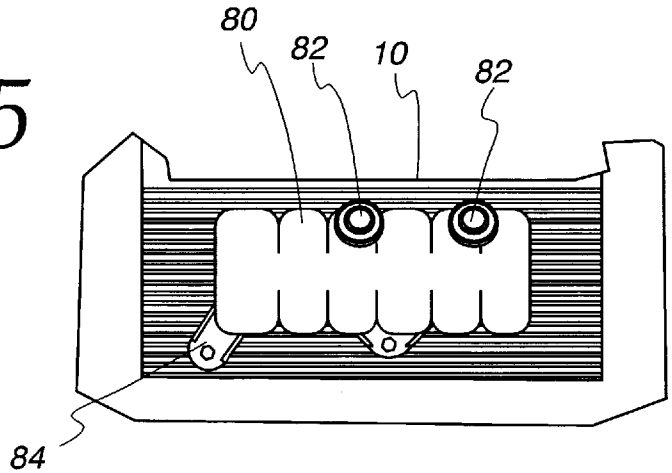
FIG. 5 is a plan view of the charge air cooler of FIG. 4 showing the equalization vessel of that embodiment.

Another form of the invention is illustrated in FIGS. 4 and 5. In this form of the invention, a relatively shallow, elongated expansion tank 80 is mounted to the heat exchanger 10, again in overlying, spaced relation. It will be appreciated from FIG. 5 that the equalization tank 10 overlies a substantial portion of the core of the heat exchanger 10. In this embodiment, no special treatment is given to the underside of the tank 80 but the same is provided with one or more ports 82, at least one of which will receive a pressure cap (not shown).

The tanks 60 and 80 may be molded out of plastic and have mounting tabs 84 as an integral part thereof. These mounting tabs may in turn be connected to bracket like fingers 90 which extend downwardly into the core 10 at locations between the tubes 18. In these locations, the fins 24 may be omitted so that the finger like mounting brackets 90 may abut the tubes 80 along their major dimension and be metallurgically bonded thereto when the tubes are formed of metal. Typically, this will occur during a brazing process at which time the headers, tanks, tubes and fins are all brazed together to form a complete heat exchanger. Alternatively, the brackets may be brazed to side plates 92 customarily found on such heat exchangers.

From the foregoing, it will be appreciated that a compact cooling system made according to the invention provides a modular construction wherein the heat exchangers, the fan and the equalization tank can all be installed in a vehicle in a one installation operation. Consequently, time and cost savings are realized. Furthermore, the advantages now being recognized of compact cooling systems are, of course, retained in the system of the invention.

We claim:

1. A compact cooling system for a vehicle comprising:

an assembly of heat exchangers connected to each other to provide a box-like configuration, each heat exchanger including a core with headers and tanks at each end in fluid communication with spaced, parallel flattened tubes in the core, and fins extending between the tubes in the core, one said core being generally horizontal and located at the upper side of said box-like configuration;

a radial fan within said box-like configuration and operable to receive cooling air and direct the cooling air radially outwardly through the cores to cool fluid passing through the tubes of each of said cores; and an equalization tank mounted to said box-like configuration in overlying, spaced relation to a substantial portion of the surface of said one core so as to be in the path of cooling air emerging from said one core to divert the same, said equalization tank having a lower, air guiding surface for directing said emerging cooling air in at least one predetermined direction, wherein said box-like configuration has a front side and a rear side and said lower surface is curved upwardly and away from said one core in the direction from said front side to said rear side.

2. The compact cooling system of claim 1, wherein said one core comprises a charge air cooler and there are at least two other cores, each with headers and tanks, one at each end of said one core and generally vertically oriented, said other cores being radiators and connected to each other and to said equalization tank.

3. A compact cooling system for a vehicle comprising:

an assembly of heat exchangers connected to each other to provide a box-like configuration, each heat exchanger including a core with headers and tanks at each end in fluid communication with spaced, parallel flattened tubes in the core, and fins extending between the tubes in the core, one said core being generally horizontal and located at the upper side of said box-like configuration, said one core including a charge air cooler;

at least two other cores, each with headers and tanks, one at each end of said one core and generally vertically oriented, said other cores being radiators and connected to each other and to said equalization tank;

a radial fan within said box-like configuration and operable to receive cooling air and direct the cooling air radially outwardly through the cores to cool fluid passing through the tubes of each of said cores;

an equalization tank mounted to said box-like configuration in overlying, spaced relation to a substantial portion of the surface of said one core so as to be in the path of cooling air emerging from said one core to divert the same; and a mounting bracket connected to said equalization tank and having a plurality of fingers bonded to the flat tubes of at least one of said cores.

4. A compact cooling system for a vehicle comprising:

an assembly of heat exchangers connected to each other to provide a box-like configuration, each heat exchanger including a core with headers and tanks at each end in fluid communication with spaced, parallel flattened tubes in the core, and fins extending between the tubes in the core, one said core being generally horizontal and located at the upper side of said box-like configuration;

a radial fan within said box-like configuration and operable to receive cooling air and direct the cooling air radially outwardly through the cores to cool fluid passing through the tubes of each of said cores;

an equalization tank mounted to said box-like configuration in overlying, spaced relation to a substantial portion of the surface of said one core so as to be in the path of cooling air emerging from said one core to divert the same; and wherein said box-like configuration has a front side and a rear side and further including a baffle plate located at said front side extending from said one core upwardly to said equalization tank.

* * * * *